US009574771B2

(12) United States Patent
Kang et al.

(10) Patent No.: US 9,574,771 B2
(45) Date of Patent: Feb. 21, 2017

(54) METHOD AND BURNER USING THE CURIE EFFECT FOR CONTROLLING REACTANT VELOCITY FOR OPERATION IN PRE-HEATED AND NON-PRE-HEATED MODES

(71) Applicant: American Air Liquide, Inc., Fremont, CA (US)

(72) Inventors: Taekyu Kang, Newark, DE (US); Robert Sokola, Newark, DE (US); Vijaykant Sadasivuni, Bear, DE (US); Hwanho Kim, Newark, DE (US)

(73) Assignee: American Air Liquide, Inc., Freemont, CA (US)

( * ) Notice: Subject to any disclaimer, the term of this patent is extended or adjusted under 35 U.S.C. 154(b) by 338 days.

(21) Appl. No.: 14/143,044

(22) Filed: Dec. 30, 2013

(65) Prior Publication Data

US 2015/0184855 A1 Jul. 2, 2015

(51) Int. Cl.

| | |
|---|---|
| ***F23N 1/00*** | (2006.01) |
| ***F23N 5/02*** | (2006.01) |
| ***F23L 13/00*** | (2006.01) |
| ***F23N 3/04*** | (2006.01) |

(52) U.S. Cl.

CPC ..... *F23N 1/005* (2013.01); *F23L 13/00* (2013.01); *F23N 3/045* (2013.01); *F23N 5/025* (2013.01)

(58) Field of Classification Search

CPC ..... F23N 1/005; F23N 3/045; F23N 5/025; F23L 13/00

See application file for complete search history.

(56) References Cited

U.S. PATENT DOCUMENTS

| | | | |
|---|---|---|---|
| 2,232,502 | A | 2/1941 | Wittmann |
| 2,233,659 | A | 3/1941 | Wittmann |
| 2,250,738 | A | 7/1941 | Wittmann |
| 2,290,049 | A | 7/1942 | Hildebrecht |
| 2,299,155 | A | 10/1942 | Lange |
| 2,303,700 | A | 12/1942 | Mantz |
| 2,359,921 | A | 10/1944 | Kliever |

(Continued)

FOREIGN PATENT DOCUMENTS

| | | |
|---|---|---|
| AU | 997 855 | 2/1969 |
| WO | WO 2012 016822 | 2/2012 |

OTHER PUBLICATIONS

International Search Report and Written Opinion for PCT/US2014/072174, mailed Mar. 18, 2015.

*Primary Examiner* — Alfred Basichas
(74) *Attorney, Agent, or Firm* — Christopher J. Cronin

(57) ABSTRACT

Methods, burner, apparatuses, and systems are provided for controlling a velocity of a jet of gas exiting a burner when the gas is heated or not and at a corresponding second higher temperature or lower first temperature. Through the use of a temperature-sensitive magnetic valve, the flow of a gas can be redirected to maintain velocity of the gas as delivered to a combustion chamber based on the temperature of the gas. The temperature-sensitive magnetic valve can redirect flow of the gas based on the magnetic state of a ferromagnetic material. The state of the temperature-sensitive magnetic valve changes based on the temperature of the gas to maintain the velocity of the gas delivered through an outlet of the burner to the combustion chamber. Thus, heated gases and standard temperature gases can be delivered at approximately equal velocities thus maintaining flame size and shape.

11 Claims, 6 Drawing Sheets

(56) References Cited

U.S. PATENT DOCUMENTS

| | | | |
|---|---|---|---|
| 2,670,035 | A | 2/1954 | Wittmann |
| 2,683,486 | A | 7/1954 | Wittmann |
| 2,688,446 | A | 9/1954 | Wittmann |
| 2,719,197 | A | 9/1955 | Hall et al. |
| 3,054,443 | A | 9/1962 | Valentine et al. |
| 4,005,726 | A | 2/1977 | Fowler |
| 6,104,008 | A | 8/2000 | Larson |
| 7,752,849 | B2 | 7/2010 | Webster et al. |
| 7,753,849 | B2 | 7/2010 | Morgan et al. |
| 2013/0294192 | A1 | 11/2013 | Son |
| 2014/0186781 | A1 | 7/2014 | Kang et al. |

METHOD AND BURNER USING THE CURIE EFFECT FOR CONTROLLING REACTANT VELOCITY FOR OPERATION IN PRE-HEATED AND NON-PRE-HEATED MODES

BACKGROUND OF THE INVENTION

Field of the Invention

Embodiments described herein generally relate to controlling the velocity of a gas flowing to a combustion chamber.

Description of the Related Art

Many industrial operations employ furnaces within which fuel and oxidant are combusted, so that the heat of combustion can heat material that is in the furnace. Examples include furnaces that heat solid material to melt it, such as smelting furnaces, and furnaces that heat objects such as steel slabs to raise the material's temperature (short of melting it) to facilitate shaping or other treatment of the material or object. The required high temperature is generally obtained by combustion of a hydrocarbon fuel such as natural gas. The combustion produces gaseous combustion products, also known as flue gas. Especially glass melting furnaces that achieve a relatively high efficiency of heat transfer from the combustion to the solid materials to be melted, the flue gases released generally reach temperatures in excess of 1300 degrees Celsius (° C.), and thus represent a considerable waste of energy that is generated in the high temperature operations, unless that heat energy can be at least partially recovered from the combustion products.

One mechanism to recover this lost energy is to preheat one or more of the combustion reactants (fuel or oxidant) using the flue gases. The combustion reactants can be heated to a desired temperature, thus increasing the heat delivered to the furnace during the combustion process. However, problems arise from the preheating of the combustion reactants. As the combustion reactants are heated in a given space, the pressure of the gases increases thereby leading to an increase in jet velocity exiting the burner. Jet velocity is the velocity with which the gases escape the burner. Increased jet velocity leads to shorter residence time before the combustion reaction which can reduce flame luminosity. A larger jet using a larger diameter of a pipe can resolve this problem, but this solution only creates a new problem when a lower reactant temperature is used. In other words, the velocity of the reactant decreases at the lower temperature in comparison to that of the reactant at the higher reactant temperatures.

Another way to overcome this problem is to use one pipe for the standard temperature fuel and another pipe for the hot fuel, with a valve switching the fuel flow between the two pipes. However, conventional valve designs used in the combustion art are complex devices that do not work well, or sometimes at all, at elevated temperatures. Further, conventional valves require manual operation (i.e. a person operating the valve based on temperature) which would require insulation and extra protection equipment for the operator. Also, insulating the valve requires even greater complexity and expense in order to ensure that the valve can perform in a routine fashion. Therefore, it is desirable for burners to have a function of automatic adjustment to maintain the proper jet velocity irrespective of the temperature change of the gas.

Thus, there is a need in the art for control of gas velocity exiting the burner during burner operations based on temperature.

SUMMARY OF THE INVENTION

The embodiments described herein generally relate to apparatus, systems and methods for controlling gas velocity exiting a burner. In one embodiment, a burner device can include a temperature-sensitive magnetic valve in fluid connection with a gas source and one or more first outlets in connection with a first pathway. The first outlets have a first cross-sectional area. The burner device also includes one or more second outlets in connection with a second pathway. The second outlets have a second cross-sectional area which is cumulatively greater than the first cross-sectional area. The temperature-sensitive magnetic valve can include a magnet, a ferromagnetic material in magnetic connection with the magnet and a flow control structure forming the first pathway and the second pathway.

In another embodiment, a burner system can include a temperature-sensitive magnetic valve having a magnet and a ferromagnetic material, a gas source coupled to the temperature-sensitive valve, a first burner outlet coupled to the temperature-sensitive magnetic valve and sized to permit gas at a first temperature to exit the first burner outlet at a first velocity and a second burner outlet coupled to the temperature-sensitive magnetic valve and sized to permit the gas at a second temperature to exit the second burner outlet at the first velocity, wherein the first burner outlet and the second burner outlet have different cross-sectional areas, and wherein the ferromagnetic material blocks the first burner outlet when magnetically coupled to the magnet and unblocks the first burner outlet when uncoupled from the magnet.

In another embodiment, a method for controlling combustion comprises delivering a gas at a first temperature to a temperature-sensitive valve, the temperature-sensitive valve comprising a magnetic material, a ferromagnetic material, a first pathway and a second pathway, wherein the gas exchanges heat with the ferromagnetic material such that the ferromagnetic material reaches the first temperature and is positioned at a first position relative to the magnetic material. The method also includes permitting the gas to flow through the first pathway that is coupled to the temperature-sensitive valve and delivering the gas at a second temperature to the temperature-sensitive valve, wherein the gas exchanges heat with the ferromagnetic material such that the ferromagnetic material reaches the second temperature. The method also includes moving the ferromagnetic material to a second position relative to the magnetic material that is different from the first position; and permitting the gas to flow through a second pathway that is coupled to the temperature-sensitive valve.

Any one or more of the embodiments may include one or more of the following aspects:

The flow control device has a plurality of first apertures and the ferromagnetic material is in fluid connection with the flow control device with plurality of second apertures formed therein.

The ferromagnetic material comprises a nickel-containing material.

The first pathway and the second pathway comprise one or more common pipes.

There is a chamber comprising a plurality of inlets and the ferromagnetic material further comprising an opening, the opening allowing substantial flow from the plurality of inlets into the chamber.

The first pathway and the second pathway comprise a pipe-in-pipe design.

The flow control structure is connected to the ferromagnetic material, wherein the flow control structure and the ferromagnetic material rotate on a pivot.

The temperature-sensitive magnetic valve further comprises a flow control structure configured to form one or more barriers to flow in conjunction with the ferromagnetic material.

The temperature-sensitive magnetic valve further comprises a restricting device configured to: change position with the ferromagnetic material; and redirect the gas based on the position of the ferromagnetic material in conjunction with the flow control structure.

There is a first flow control structure connected to the ferromagnetic material, the first flow control structure configured to restrict flow based on the temperature of the ferromagnetic material, wherein the flow control structure and the ferromagnetic material rotate on a pivot.

There is a second flow control structure with a plurality of apertures, the second flow control structure in fluid connection with the first flow control structure.

There is a chamber comprising the flow control structure positioned between a plurality of magnets, the flow control structure connected with the ferromagnetic material.

There is a protective cover configured to: isolate the ferromagnetic material or the magnet from the gas and transmit heat to at least the ferromagnetic material.

There is a first flow control structure connected to the ferromagnetic material, the first flow control structure configured to restrict flow based on the temperature of the ferromagnetic material, wherein the flow control structure and the ferromagnetic material rotate on a pivot.

The gas is either an oxidant or a fuel.

The ferromagnetic material comprises nickel.

The first pathway further comprises one or more first outlets.

The second pathway has one or more second outlets which have a cumulative cross-sectional area which is greater than the first pathway.

If and when the temperature-sensitive valve fails, placing a magnet in a position sufficient to induce the ferromagnetic material to either the first position or the second position.

The first temperature is the prevailing ambient temperature and the second temperature is a predetermined temperature to which the gas has been preheated prior to said step of delivering the gas at a second temperature.

The gas is a fuel.

The gas is natural gas.

The gas is preheated to the second temperature through heat exchange with hot air that has been preheated through heat exchange with combustion gases resulting from combustion of gas injected by the burner

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings.

It is to be noted, however, that the appended drawings illustrate only typical embodiments of this invention and are therefore not to be considered limiting of its scope, for the invention may admit to other equally effective embodiments.

To facilitate understanding, identical reference numerals have been used, where possible, to designate identical elements that are common to the figures. It is contemplated that elements disclosed in one embodiment may be beneficially utilized on other embodiments without specific recitation.

DETAILED DESCRIPTION

Figure 1A:
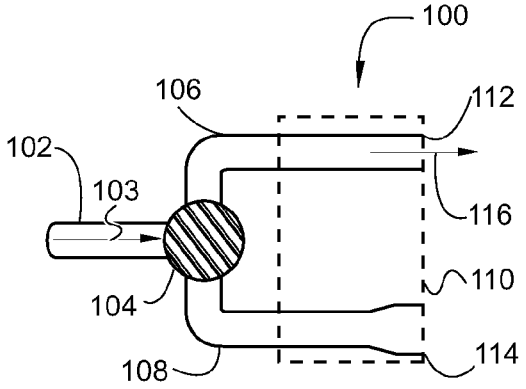
FIGS. 1A-1F are schematic views of a burner device including a temperature-sensitive magnetic valve according to one or more embodiments.

Burners, apparatuses, systems, and methods for controlling gas velocity exiting through an outlet in a burner are disclosed herein. Significant energy is lost during the combustion process, specifically through heat that escapes to the atmosphere in flue gases. For example, in an oxy-fuel fired glass furnace where all the fuel is combusted with pure oxygen, and for which the temperature of the flue gas at the furnace exhaust is of the order of 1350° C., typically 30% to 40% of the energy released by the combustion of the fuel is lost in the flue gas. In embodiments described herein, a gas, such as gaseous fuel or oxidant, can be preheated prior to delivery to a combustion chamber through an outlet in a burner. The flow of the gas, whether preheated or standard temperature, can be redirected using a temperature-sensitive magnetic valve through one or more pathways. The gas can then be delivered via one of the pathways to the combustion chamber by exiting through one or more outlets. The outlets, either individually or as a group, can have a cross-sectional area which allows for a substantially constant velocity of gas exiting the outlets of the burner for operation involving two predetermined temperature ranges for the gas. The embodiments disclosed herein are more clearly described with reference to the figures below.

As discussed above, the temperature-sensitive magnetic valve operates to ensure that the velocity of the gas exiting the burner remains substantially the same, whether the gas is preheated to a pre-selected temperature range or not. For simplicity, the ideal gas law will be used to explain how a substantially constant velocity is maintained. As is well known, the ideal gas law states that the product of the pressure of a gas and the volume of the gas equals the product of the moles of the gas, the temperature of the gas, and the universal gas constant (i.e., $PV=nRT$). If the temperature changes (e.g., the gas delivered to the valve increases), then the volume of the gas increases if pressure is held constant. Thus, gas passing through the same outlet at different temperatures will have a velocity due to the different volume. To ensure that different temperature gases exit the burner at the same velocity, the increase in volume (due to the increase in temperature), must be accounted for. To account for the increase in volume, the gas at the higher temperature may be directed to a different outlet that is sized to permit the gas to exit the different outlet at substantially the same velocity as the gas at the lower temperature exits the original outlet. Because the velocity of the jet of gas remains the same, whether the gas is at the first temperature or at the second temperature, the flame resulting from combustion of the gas jet (with another combustion reactant) will have a same size and shape. This solves the problem associated with changes in flame size and shape that are experienced by conventional burners operated in heated gas or non-heated gas modes.

In the embodiments discussed herein, the gases may be delivered within a temperature range of between about 25 degrees Celsius and about 800 degrees Celsius. Additionally, in the embodiments discussed herein, the ferromagnetic material may be chosen to have a curie temperature between about 240 degrees Celsius and about 600 degrees Celsius. In general, the desired temperature to which the gas is preheated, the typical non-preheated gas temperature, and the desired jet velocity (of the gas exiting the outlet) drive selection of the cumulative cross-sectional areas for the first and second flow paths and drive selection of the particular temperature selective magnet.

Take, for example, a first flow path for non-preheated gas and a second flow path for preheated gas where the typical non-preheated temperature is ambient (25° C. or 298° K), the desired jet velocity is 100 m/s, and the desired preheated gas temperature is 480° C. (753° K). In this case, the temperature has increased by about 53%, so the cross-sectional area for the second flow path should be about 53% greater than that of the first flow path plus the material for the temperature selective magnet is chosen so as to exhibit the curie effect at a temperature lower than 480° C. This will help to ensure that the jet velocity will be substantially the same whether the gas temperature is ambient or 480° C. One of ordinary skill in the art will recognize that selection of the first and second gas temperatures is only limited by the availability of materials exhibiting the curie effect at temperatures in between the first and second gas temperatures. Such a one will further recognize that the first and second gas temperatures are typically driven by process requirements.

While two flow paths and two operating temperatures are disclosed, it is within the scope of the invention to utilize three or more flow paths corresponding to three or more operating temperatures. The ultimate number of flow paths is only limited by the tradeoff between expense and complexity of such a device and the desirability of having a substantially constant jet velocity at each of the different operating temperatures.

While the invention may be used in any of a wide variety of combustion processes, one typical process is a glass furnace where either the oxidant (such as air, oxygen-enriched air or oxygen) and/or the fuel is preheated at a heat exchanger with heat from either combustion gases from the furnace or with heat from air that is itself preheated from heat from the combustion gases. The first temperature corresponds to a first mode of operation in which the oxidant and/or the fuel is not preheated at the heat exchanger. The second temperature corresponds to a second mode of operation in which the oxidant and/or the fuel is preheated at the heat exchanger.

Figure 1B:
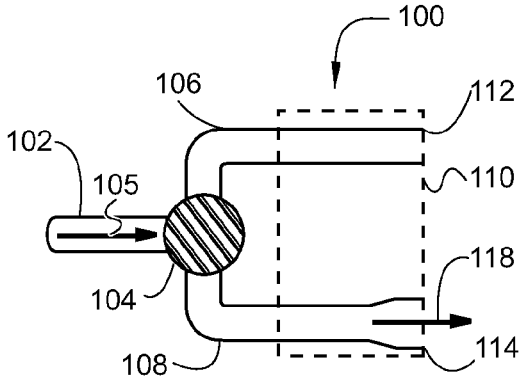

FIGS. 1A-1F are schematic views of a burner system including a temperature-sensitive magnetic valve according to one or more embodiments. FIGS. 1A and 1B depict a burner system 100 according to one embodiment. The burner system 100 includes an inlet 102, a temperature-sensitive magnetic valve 104, a first pathway, depicted here as first tube 106, a second pathway, depicted here as a second tube 108, and a burner block 110. A first gas 103 or a second gas 105 is delivered through the inlet 102 to the temperature-sensitive magnetic valve 104.

The first gas 103, shown in FIG. 1A, can be a gas used in a combustion process, such as a fuel gas or an oxidizing gas. The first gas 103 can further include inert gases, such as nitrogen or a noble gas. When the first gas 103 reaches the temperature-sensitive magnetic valve 104, the first gas 103 then equilibrates temperature with the temperature-sensitive magnetic valve 104. The parts of the burners may comprise refractory oxides such as silica, alumina, alumina-zirconia-silica, zirconia and the like. Alternatively, certain metallic alloys that do not combust in preheated oxygen use may be used.

The temperature-sensitive magnetic valve 104 can have a plurality of states. The temperature-sensitive magnetic valve 104 has a first state and a second state, such that gas flows through the first tube 106 when in the first state and the gas flows through the second tube 108 when in the second state. The temperature-sensitive magnetic valve 104 includes at least a magnet and a ferromagnetic material. When in the first state, the ferromagnetic material is magnetically coupled to the magnet. When the temperature of the ferromagnetic material increases, the ferromagnetic material loses its magnetic properties and thus magnetically decoupled from the magnet. The magnetic decoupling occurs because the ferromagnetic material reaches a curie effect temperature and loses attraction to the magnet. Once the ferromagnetic material reaches the curie effect temperature, the ferromagnetic material moves away from the magnetic and, thus, the valve shifts to a second state. In the first state (shown in FIG. 1A), the temperature-sensitive magnetic valve 104 prevents flow of the gas 103 through the second tube 108 while allowing flow through the first tube 106. The temperature-sensitive magnetic valve 104 will be described in more detail with reference to FIGS. 3A-8B. The first tube 106 leads through the burner block 100 to the first outlet 112. The first outlet 112 has a cross-sectional area such that the exiting gas 116 passes through the first outlet at a first velocity to the combustion chamber.

As discussed above, then the ferromagnetic material reaches the curie effect temperature for the particular ferromagnetic material, the ferromagnetic material magnetically decouples from the magnet and thus, physically moves away from the magnet. Due to the movement of the ferromagnetic material, the valve 104 operates to alter the flowpath of the gas passing through the valve. As shown in FIG. 1B, the second gas 105 is delivered through the inlet 102. The temperature-sensitive magnetic valve 104 directs the second gas 105 through the second tube 108. The increase in temperature of the ferromagnetic material caused by the increase in temperature from the second gas 105 causes the temperature-sensitive magnetic valve 104 to shift from the first state to the second state based on reaching the threshold or curie-effect temperature.

When the temperature-sensitive magnetic valve 104 shifts from the first state to the second state, the flow of gas is shifted from the first tube 106 (the first pathway) to the second tube 108 (the second pathway). The second tube 108 leads through the burner block 110 to the second outlet 114. The second outlet 112 has a cross-sectional area that is different than the cross-sectional area of the first outlet 112. Because the cross-sectional area of the first outlet is appropriately selected to correspond with the predominant temperature of the first state (such as the prevailing ambient temperature) and the cross-sectional area of the second outlet is appropriately selected to correspond with the predominant temperature of the second state (such as 480° C.), the exiting gas 118 exits the second outlet 114 at the same velocity as the gas exiting the first outlet 112. Though depicted in FIGS. 1A and 1B as the first tube 106 and the second tube 108, the first pathway and second pathway can be any combination of one or more tubes or connections used to deliver the gas through the burner to the combustion chamber. Further, the first pathway and the second pathway can have one or more connections which overlap, as shown in embodiments described herein.

Figure 1C:
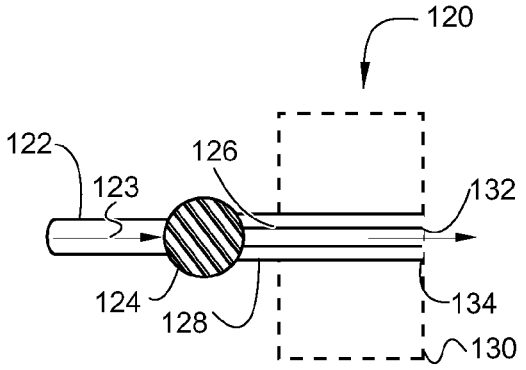
Figure 1D:
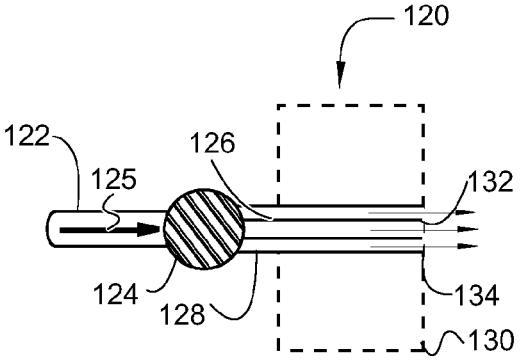

FIGS. 1C and 1D depict a burner system 120 according to another embodiment. The burner system 120 described here includes an inlet 122, a temperature-sensitive magnetic valve 124, a first tube 126 and a second tube 128, depicted here as a pipe-in-pipe design, and a burner block 130. A first gas 123 or a second gas 125 is delivered through the inlet 122 to the temperature-sensitive magnetic valve 124 where the gas is directed to flow through either the first tube 126 where the gas exits the first outlet 132 or to the second tube 128 where the gas exits the second outlet 134. As shown in FIG. 1D, the gas can be directed to pass through both the first tube 126 and the second tube 128. In either flow path, the gas exiting the first outlet 132 has substantially the same velocity as the gas exiting the second outlet 134 because the cross-sectional areas for the first and second outlets 132, 134 have been selected to correspond to the predominant temperatures associated with the first and second states.

Figure 1E:
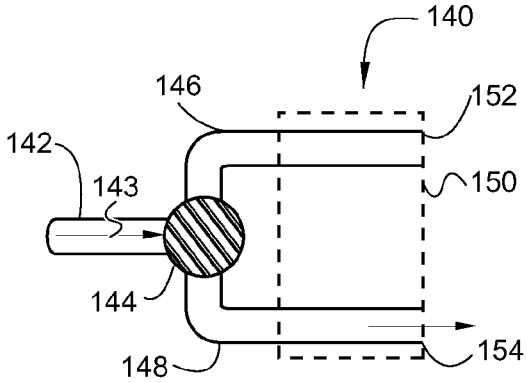
Figure 1F:
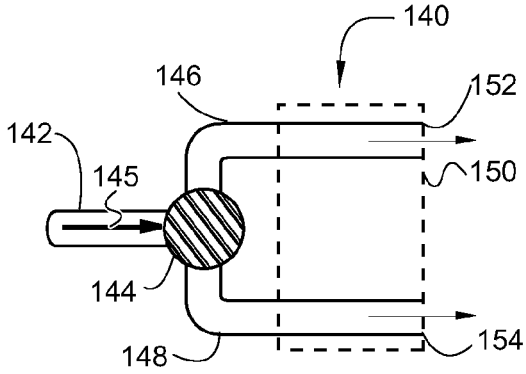

FIGS. 1E and 1F depict a burner system 140 according to another embodiment. The burner system 140 described here includes an inlet 142, a temperature-sensitive magnetic valve 144, a first pathway, depicted here as first tube 146, a second pathway, depicted here as a second tube 148, and a burner block 150. A first gas 143 or a second gas 145 is delivered through the inlet 142 to the temperature-sensitive magnetic valve 144 where the gas is directed to flow through either the first tube 146 where the gas exits the burner 150 through a first outlet 152 or both the first tube 146 and the second tube 148 where the gas exits the burner 150 through a second outlet 154. In either flow path, the gas exiting the first outlet 152 has substantially the same velocity as the gas exiting the second outlet 154 because the cross-sectional areas for the first and second outlets 152, 154 have been selected to correspond to the predominant temperatures associated with the first and second states.

Therefore, so long as the cross-sectional area of the outlet associated with the second flow path is sized to achieve a particular jet velocity at a second desired gas temperature and the cross-sectional area of the outlet associated with the first flow path is sized to achieve a same jet velocity at a first desired gas temperature, by using the temperature-sensitive magnetic valve, the jet velocity of the gas exiting the burner is the same whether the gas is at the first or second temperature.

Figure 2A:
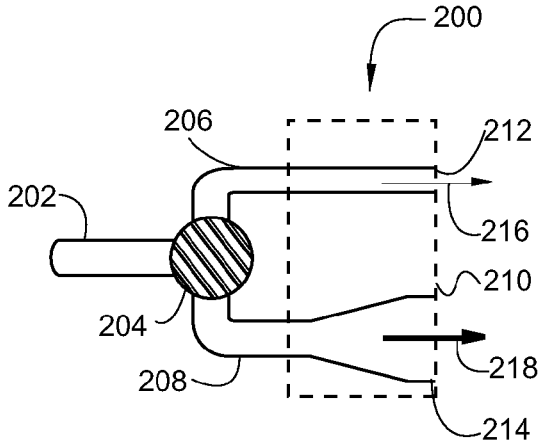
FIGS. 2A-2F are schematic views of a burner device including a temperature-sensitive magnetic valve according to further embodiments.
Figure 2B:
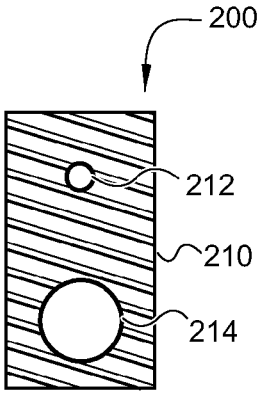

FIG. 2A-2F are schematic views of a burner device including a temperature-sensitive magnetic valve according to further embodiments. FIGS. 2A and 2B depict a side and front view of a burner device 200 according to one embodiment. Depicted in FIG. 2A, the burner device 200 includes an inlet 202 in fluid connection with a temperature-sensitive magnetic valve 204. The temperature-sensitive magnetic valve 204 fluidly connects the inlet 202 with a first pipe 206 and a second pipe 208. The first pipe 206 and the second pipe 208 are configured to deliver exiting first gas 216 or exiting second gas 218 through a burner block 210 and through the first outlet 212 and the second outlet 214. As described above, the cross-sectional area of the second outlet 214 is greater than the cross-sectional area of the first outlet 212, such that the velocity of the gas 216 exiting the first outlet 212 and the gas 218 exiting the second outlet 214 are substantially the same because the cross-sectional areas of the first and second outlets 212, 214 are appropriately sized.

As shown in FIG. 2B, both the first outlet 212 and the second outlet 214 are depicted as being circular. However, any shape or combination of shapes may form the perimeter of the first outlet 212 or the second outlet 214. It is not necessary that the shapes be the same between the first outlet 212 and the second outlet 214, so long as the cross-sectional area of the first outlet 212 and the second outlet 214 are shaped to permit the gases exiting the outlets to flow at substantially the same velocity even though the gases are at different temperatures. Therefore, the first outlet 212 and the second outlet 214 can have a variety of shapes, designs or further components which may be incorporated into one or more nozzles for use in a burner.

Figure 2C:
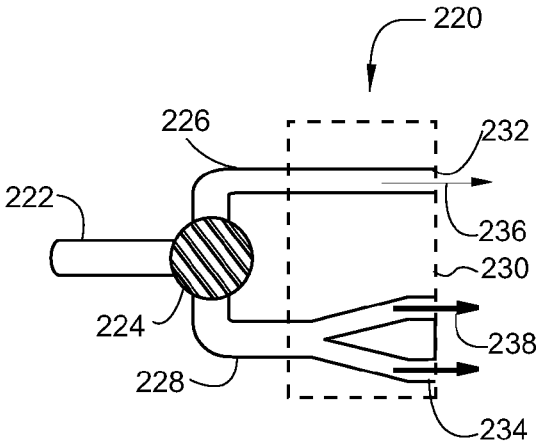
Figure 2D:
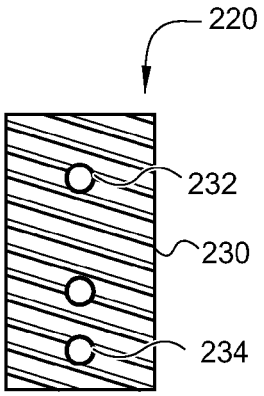

FIGS. 2C and 2D depict a side and front view of a burner device 220 according to another embodiment. FIG. 2C shows a burner device 220 from a side view, including an inlet 222, a temperature-sensitive magnetic valve 224, a first pipe 226 and a second pipe 228. The inlet 222, the temperature-sensitive magnetic valve 224, the first pipe 226 and the second pipe 228 can be substantially similar to those described with reference to FIG. 2A. The first pipe 226 and the second pipe 228 are configured to deliver a first gas 236 or a second gas 238 through the first outlet 232 and the second outlets 234 formed in connection with the burner block 230. In this design, the second outlets 234 have an increased collective cross-sectional area for the second gas 238 by using multiple tubes, as opposed to using a larger tube.

Figure 2E:
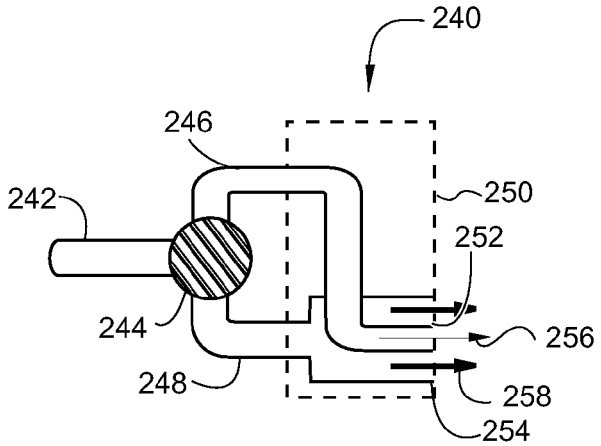
Figure 2F:
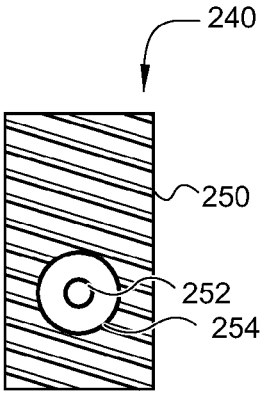

FIGS. 2E and 2F depict a side and front view of a burner device 240 according to another embodiment. FIG. 2E shows a burner device 240 from a side view, including an inlet 242, a temperature-sensitive magnetic valve 244, a first pipe 246 and a second pipe 248. The inlet 242, the temperature-sensitive magnetic valve 244, the first pipe 246 and the second pipe 248 can be substantially similar to those described with reference to FIG. 2A. The first pipe 246 and the second pipe 248 are configured to deliver an exiting first gas 256 or a second gas 258 through the first outlet 252 and the second outlet 254 formed in connection with the burner block 250. The first outlet 252 and the second outlet 254 depict a pipe-in-pipe design wherein the first pipe 246 delivers the first gas 256 through the centrally located first outlet 252. The first outlet 252 is surrounded by the second outlet 254 which delivers the second gas 258 to the combustion chamber at a substantially identical velocity as the first gas 256. Though shown here as delivering the second gas 258 through a different outlet than the first gas 256, the second gas 258 can be delivered through both the first outlet 252 and the second outlet 254, as directed by the temperature-sensitive magnetic valve 244.

Though shown here as permutations of a dual pipe embodiment, various designs may be employed to control velocity of gases delivered through the outlets. In general, the designs for both the valves and the pipes are only limited by the desire to maintain the same gas velocity when delivering either heated or standard temperature gases through an outlet in a burner.

Embodiments described herein relate to relevant portions of a typical burner useable with one or more embodiments of the invention. There can be other components that are not explicitly named which may be included or excluded based on the choice of design and other parameters. The components described herein may differ in shape, size or positioning from those used in practice. Further, the embodiments described herein are for exemplary purposes and should not be read as limiting of the scope of the invention described herein, unless explicitly limited herein.

FIGS. 3-8 are representations of temperature sensitive magnetic valves, according to one or more embodiments. The temperature sensitive magnetic valves described herein can be used with embodiments described above. Further, the temperature-sensitive magnetic valves described below can be beneficially incorporated into a burner which has not been disclosed herein. The disclosed embodiments are individual embodiments and are not intended to be limiting of the scope of all possible embodiments.

Figure 3A:
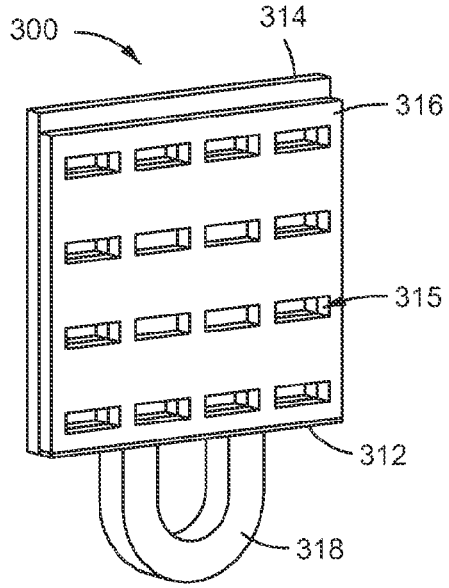
FIGS. 3A-3B are representations of the temperature-sensitive magnetic valve according to another embodiment.
Figure 3B:
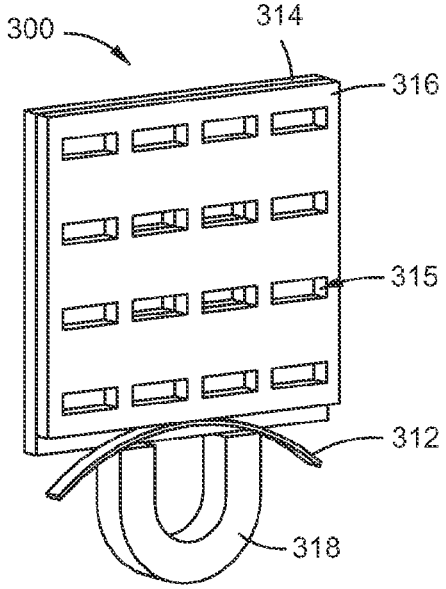

FIGS. 3A and 3B depict a portion of the temperature-sensitive magnetic valve 300 according to one embodiment. The temperature-sensitive magnetic valve 300 described herein can be used to redirect the gas passing through the valve through one or more pre-configured pathways to ensure that the gas exiting the burner has a substantially constant jet velocity regardless of the temperature of the gas.

In this embodiment, a magnet 318, a ferromagnetic material 316, a flow control structure 314 and a plurality of ports 315 are shown without a valve chamber, for clarity. The valve chamber is more clearly described with reference to FIGS. 4A and 4B. The magnet 318 is bound to the flow control structure 314. In the first graphic, the magnet 318 is applying a magnetic force to the ferromagnetic material 316 which shifts the ferromagnetic material 316 into a first state.

The magnet 318 can be positioned in proximity of the ferromagnetic material 316. The magnet 318 can be of a standard composition for a high temperature magnet, such an AlNiCo magnet. Though shown here as connected with the flow control structure 314, the magnet 318 can be positioned either internal, external or as part of the flow control structure 314. Further, the magnet 318 can be an electromagnet or a permanent magnet. In embodiments described here, the magnet 318 is shown as a permanent magnet.

The ferromagnetic material 316 is a ferromagnetic material which becomes paramagnetic at a specific temperature, known as the curie-effect temperature. The curie-effect temperature of a substance is dependent upon the composition of the substance. In one or more embodiments, the ferromagnetic material 316 is primarily nickel, which has a curie-effect temperature of 358° C. In one embodiment, the ferromagnetic material 316 is a nickel alloy which contains more than 95% nickel, such as nickel alloy 200. The ferromagnetic material 316 can be of any composition which has a curie-effect temperature in the desired range.

The ferromagnetic material 316 as positioned with the flow control structure 314, creates a plurality of ports 315 for gas to flow through, shown here as twelve (12) open ports 315 of approximately equal size. Though a specific number and similar approximate size of the ports 315 is shown in this embodiment, it will be appreciated by one skilled in the art that the number and size of ports 315 available can be changed. In either state of the temperature-sensitive magnetic valve 300, the port size, number and organization can be altered and adjusted based on the needs or desires of the user. The ports 315 need not be positioned uniformly nor be of the same size.

As gas flows through the temperature-sensitive magnetic valve 300, the ferromagnetic material 316 equilibrates to the temperature of the gas, as shown in FIG. 3B. Once the ferromagnetic material 316 has reached the curie-effect temperature as related to the composition, the magnet 318 can no longer attract the ferromagnetic material 316 by applying magnetic force. The spring 312, shown here as a leaf spring, then applies a second force to the ferromagnetic material 316 which lifts the ferromagnetic material 316 to a second state. As shown here, four (4) ports 315 are aligned, and thus open, between the ferromagnetic material 316 and the flow control structure 314.

Embodiments herein generally rely on one or more sources of force to actuate between the first state and the second state, shown here as the spring 312. When the ferromagnetic material 316 reaches the curie-effect temperature, the magnet 318, which acts as the first source of force, no longer holds the ferromagnetic material 316 in place. The second source of force, in the absence of the first source of force, moves the ferromagnetic material 316 and the flow control structure 314 to a second state. Examples of the second source of force can include springs, gravity, pressure (such as dynamic or differential static pressures) or even additional magnets (such as magnets acting on a different section, a different material e.g. carbon steel, or with a different strength).

Without intending to be bound by theory, most simple designs utilize actuation that moves a single component only a few millimeters due to the limited range of the magnetic field. As such, several magnets can be "cascaded" to increase the range of movement. Advantageously, it is believed to be possible to move the actuator a much greater distance using cascaded magnets. A ferromagnetic material can only travel a certain distance relative to a fixed magnet. Thus, by using more than one magnet with at least one intermediate magnet which is not stationary, the overall travel distance can be increased. Further, the valve could be gradually closed using a multiple magnet design. If oriented properly or composed of ferromagnetic materials with separate curie-effect temperatures, the individual ferromagnetic materials used for actuation would reach the threshold temperature at different rates. This is believed to create a time delay between when the preheated gas is delivered and when the ferromagnetic material actually heats up sufficiently. The time delay can be based on convective heat transfer which itself depends on material properties and flow dynamics/geometry (which can be altered between components to achieve different delays). One skilled in the art will understand that there are various permutations of the cascading design which can be employed without diverging from the invention described herein. Possible designs include any design which maintains the same gas velocity between heated and standard temperature gases delivered through outlets in the burner.

Figure 4A:
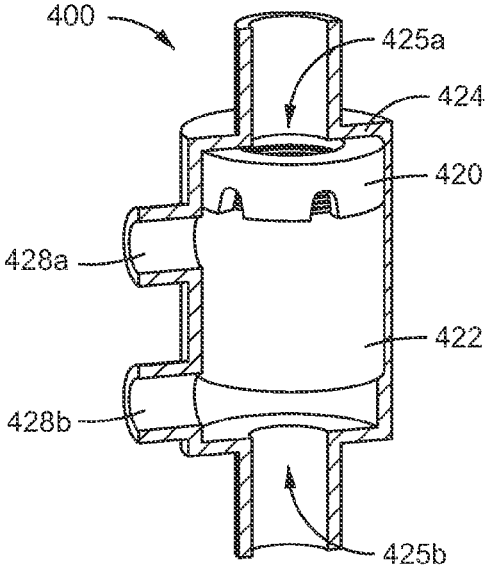
FIGS. 4A-4B are representations of the temperature-sensitive magnetic valve according to another embodiment.
Figure 4B:
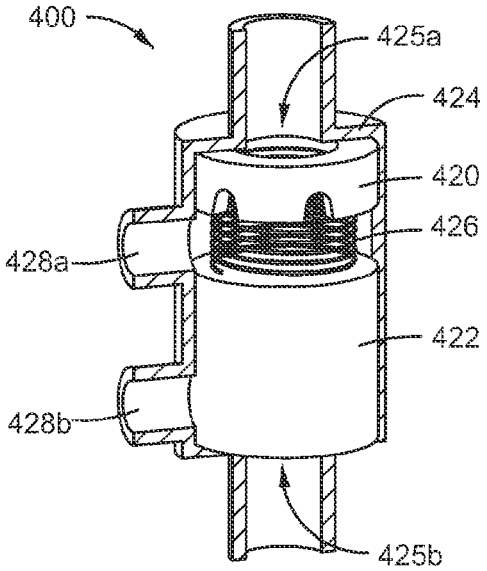

FIGS. 4A and 4B depict the temperature-sensitive magnetic valve 400 in a tube-spring design according to another embodiment. In one embodiment, the gas can flow into apertures 428*a* and 428*b* formed in a valve chamber 424. The valve chamber 424 can be fluidly sealed providing for the controlled flow of the gases. The valve chamber 424 can be composed of a material which is resistant to at least the expected levels of heat from and the chemistry of the gases delivered. In one embodiment, the valve chamber 424 is composed of a ceramic or metals coated with a ceramic. Though the valve chamber 424 is shown as a cylindrical structure, this is not intended to be limiting of the possible embodiments. For example, the valve chamber 424 can be square, rectangular, cylindrical, circular, or combinations of those shapes or other shapes.

Positioned inside of the temperature-sensitive magnetic valve 400 is a ferromagnetic material 422 that is magnetically connected with a magnet 420. In this embodiment, the magnet 420 is stationary. The ferromagnetic material 422, shown in FIG. 4A, is below the curie-effect temperature. Thus, the ferromagnetic material 422 is in contact with the magnet 420 and thus in the first state. The first state redirects flow by preventing flow through one of the apertures 428*a* as well as preventing flow through one of the ports 425*a*.

In FIG. 4B, as the gas heats up based on the pre-heating process, the gas transfers heat to the ferromagnetic material 422. The ferromagnetic material 422, once it heats above the curie-effect temperature, then is separated from the magnet 420 using a second force, shown here as delivered by a spring 426 or other combinations not specifically disclosed herein. Depending on the positioning of the temperature-sensitive magnetic valve 400 in this embodiment, the second force may also be gravity in combination with spring 426. The second force moves the ferromagnetic material 422 into a second state. The ferromagnetic material 422 in the second state blocks both the aperture 428*b* and the port 425*b*, thus redirecting flow through the previously closed aperture 428*a* and port 425*a*. In short, the first or lower temperature gas will be delivered to the burner (not shown) through the port 425*a* and the second or higher temperature gas will be delivered to the burner through the port 425*b*. In one embodiment, the port 425*a* can connect through a pathway to an outlet (not shown) in a burner having a cross-sectional area which is larger than the outlet (not shown) connected with port 425*b*.

Figure 5A:
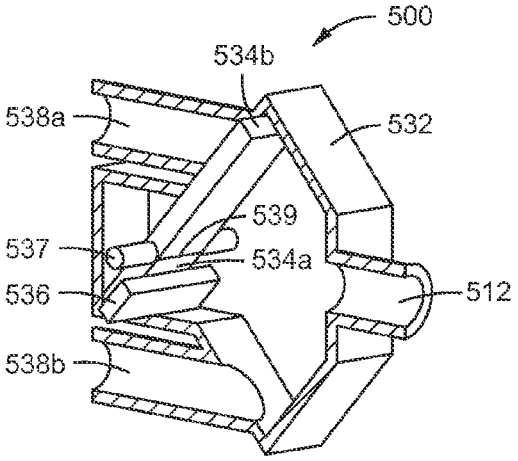
FIGS. 5A-5B are representations of the temperature-sensitive magnetic valve according to another embodiment.
Figure 5B:
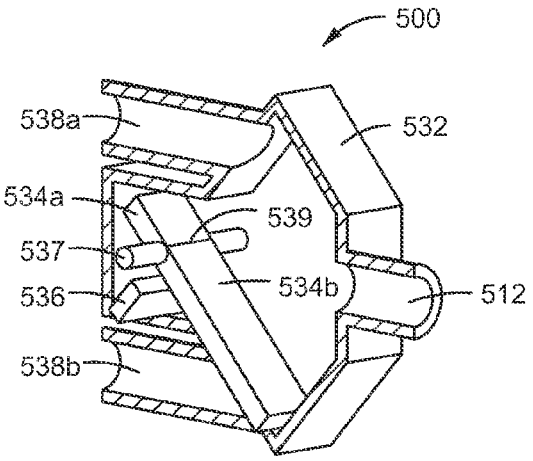

FIGS. 5A and 5B depict the temperature-sensitive magnetic valve 500 in a rotating latch design according to another embodiment. In this embodiment, the temperature-sensitive magnetic valve 500 includes a valve chamber 532, a ferromagnetic material 534*a*, a flow control structure 534*b* and a magnet 536. As shown in FIG. 5A, at temperatures below the curie-effect temperature, the ferromagnetic material 534*a* is in contact with the magnet 536. The magnet 536 can be a stationary high-temperature magnet, such as an AlNiCo magnet. While in contact with the magnet 536, the ferromagnetic material 534*a* and the flow control structure 534*b* can be considered to be in a first state and can prevent flow of a gas through a port 538*a*.

The heated state, or second state, is shown in FIG. 5B. When a second gas having a temperature above the curie-effect temperature of the ferromagnetic material 534*a* flows through an aperture 530 and into the valve chamber 532, the ferromagnetic material 534*a* and the flow control structure 534*b* begins to heat up. Once the ferromagnetic material 534*a* reaches the curie-effect temperature, the ferromagnetic material 534*a* is no longer attracted by the magnet 536 and a second force, shown here as gravity, forces the ferromagnetic material 534*a* and the flow control structure 534*b* to rotate on pivot 537 into a second state. The ferromagnetic material 534*a* and the flow control structure 534*b* in the second state block flow through port 538*b* and redirects flow through port 538*a*, as delivered through the aperture 530. By redirecting flow through port 538*a*, the preheated gas can exit the burner at a substantially the same velocity as the standard temperature gas.

The ferromagnetic material 534*a* and the flow control structure 534*b* can be composed of the same material or separate materials. As only the ferromagnetic material 534*a* needs to be composed of a temperature-sensitive substance, the composition of the flow control structure 534*b* beyond pivot 537 can be different from the ferromagnetic material 534*a* before pivot 537, as measured from the magnet 536. For example, the composition of flow control structure 534*b* beyond an imaginary line 539 can be a material which is more or less dense than the composition of ferromagnetic material 534*a*. The imaginary line 539 need not be positioned at the pivot 537 and the separation between the ferromagnetic material 534*a* and the flow control structure 534*b* can be at any point along the combination.

One or more embodiments can employ rotating components or be adapted to use rotating components, as shown in the exemplary embodiment of FIGS. 5A and 5B. As the components of the temperature-sensitive magnetic valve 500 are designed to function largely without human intervention and at high temperatures, friction between components should be minimized. Bearings or high temperature lubricants can be employed in one or more embodiments to reduce friction related issues.

Figure 6A:
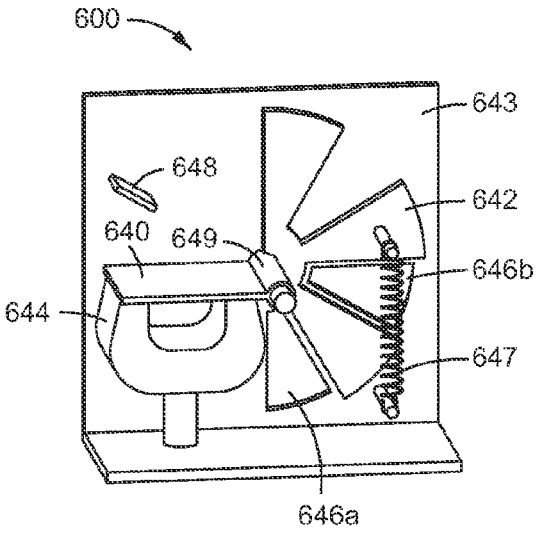
FIGS. 6A-6B are representations of the temperature-sensitive magnetic valve according to another embodiment.
Figure 6B:
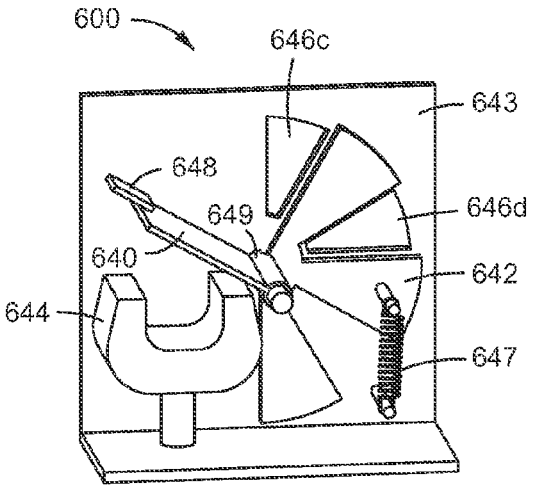

FIGS. 6A and 6B depict the temperature-sensitive magnetic valve 600 in a rotating leaf/spring design according to another embodiment. In this embodiment, the temperature-sensitive magnetic valve 600 includes a valve chamber (not shown), a ferromagnetic material 640, a restricting device 642, a flow control structure 643 and a magnet 644. As described previously, at temperatures below the curie-effect temperature, the ferromagnetic material 640 is in contact with the magnet 644. The magnet 644 is a stationary high-temperature magnet, such as an AlNiCo magnet. While in contact with the magnet 644, as shown in FIG. 6A, the ferromagnetic material 640 and the restricting device 642 are considered to be in a first state and prevent flow of a gas through one or more ports 646. In this embodiment, two ports 646*a* and 646*b* are open in the first state with a total of four ports 646*a*, 646*b*, 646*c*, and 646*d* available, when considering both open and closed ports in the flow control structure 643. However, more or fewer ports may be used without diverging from the invention described herein.

When a second, higher temperature gas flows into the valve chamber, the ferromagnetic material 640 can begin to heat up, described with reference to FIG. 6B. Once the ferromagnetic material 640 reaches the curie-effect temperature, the ferromagnetic material 640 can be separated from the magnet 644. The restricting device 642 is then forced in combination with the connected ferromagnetic material 640 into a second state by a second force, shown here as a spring 647. The ferromagnetic material 640 and the restricting device 642 rotate on a pivot 649 until the ferromagnetic material 640 reaches a barrier 648 which prevents further rotation. The restricting device 642 in the second state blocks flow through the ports 646*a* and 646*b* and redirects flow of the gas through ports 646*c* and 646*d*. Ports 646*c* and 646*d* deliver the gas through a pathway and subsequently through an outlet which has a shape and size to maintain a substantially constant jet velocity of the gas exiting the burner regardless of the temperature of the gas.

Figure 7A:
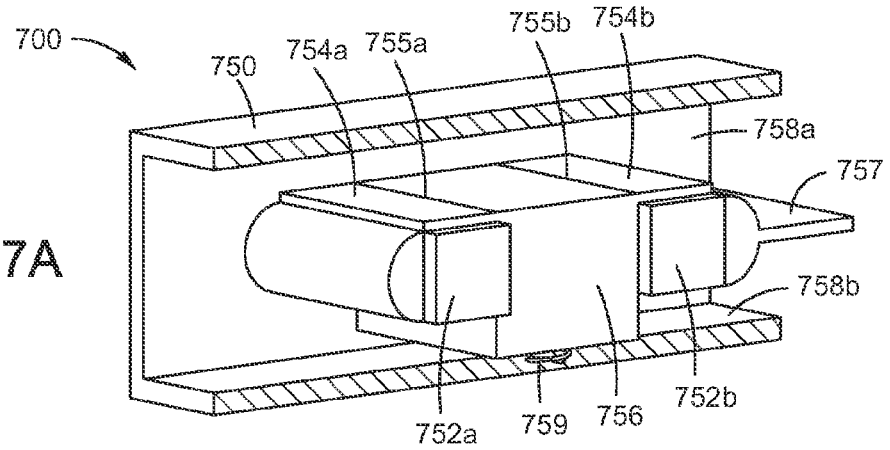
FIGS. 7A-7B are representations of the temperature-sensitive magnetic valve according to another embodiment.
Figure 7B:
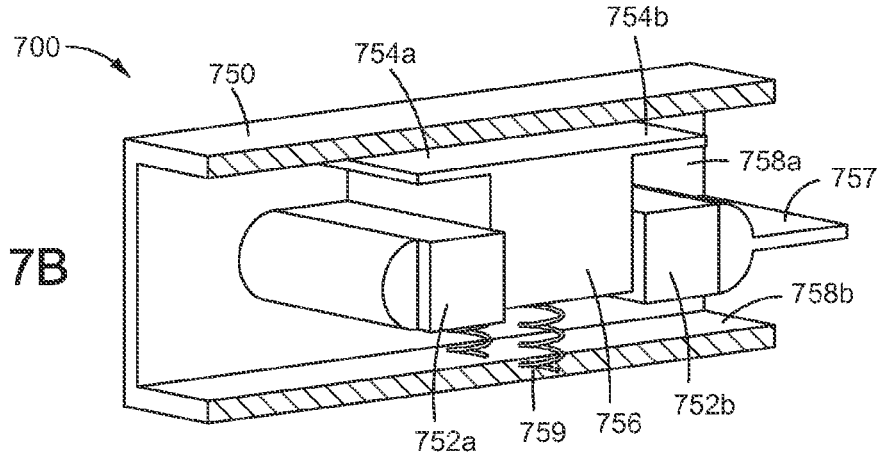

FIGS. 7A and 7B depict the temperature-sensitive magnetic valve 700 with a lifting restricting device design according to another embodiment. The temperature-sensitive magnetic valve 700 includes a valve chamber 750, magnets 752*a* and 752*b*, ferromagnetic materials 754*a* and 754*b*, a restricting device 756 and flow control structure 757. The ferromagnetic materials 754*a* and 754*b* can be in contact with the magnets 752*a* and 752*b* under standard temperatures. A gas can be delivered through aperture 751 and into the valve chamber 750, shown in FIG. 7A. As the ferromagnetic materials 754*a* and 754*b* are attached to the restricting device 756 and in the first state, the gas delivered through the aperture 751 can be directed through port 758*a* formed by the flow control structure 757. In this embodiment, the restricting device 756 is positioned between the magnets 752*a* and 752*b*. The magnets 752*a* and 752*b* can serve as a guide for the temperature-sensitive actuation of the ferromagnetic materials 754*a* and 754*b* and the restricting device 756.

When a higher temperature gas flows into the valve chamber 750, shown in FIG. 7B, the ferromagnetic materials 754*a* and 754*b* can begin to heat up. Once the ferromagnetic materials 754*a* and 754*b* reach the curie-effect temperature, the ferromagnetic materials 754*a* and 754*b* are separated from the magnets 752*a* and 752*b*. The restricting device 756 is then positioned with the connected ferromagnetic materials 754*a* and 754*b* into a second state by a second force, shown here as springs 759. The ferromagnetic materials 754*a* and 754*b* and the restricting device 756 slide into position until the ferromagnetic materials 754*a* and 754*b* and the restricting device 756 reach a wall of the valve chamber 750 which prevents further movement. The restricting device 756 in the second state blocks flow through the ports 746*a* and 746*b* and redirects flow through port 758*b*.

As stated with reference to other embodiments, ferromagnetic materials 754*a* and 754*b* may be of the same composition as one another, the same composition as the restricting device 756 or of different compositions based on the needs of the user. The imaginary lines 755*a* and 755*b* are positioned for exemplary purposes and the imaginary lines 755*a* and 755*b* between the ferromagnetic materials 754*a* and 754*b* and the restricting device 756 may be more or fewer than two, may be in different positions than shown or may not exist, in one or more embodiments.

Figure 8A:
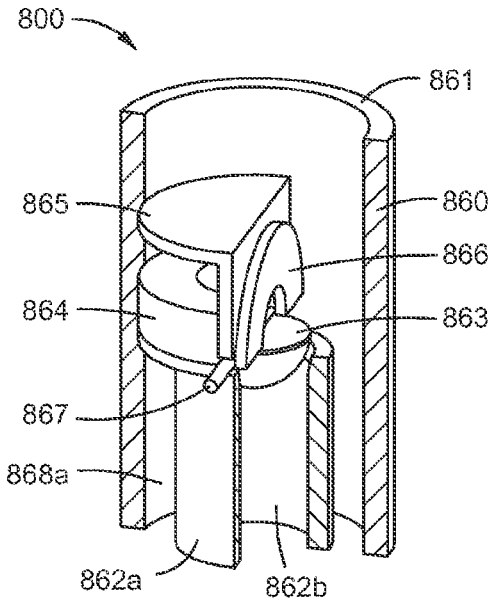
FIGS. 8A-8B are representations of the temperature-sensitive magnetic valve according to another embodiment.
Figure 8B:
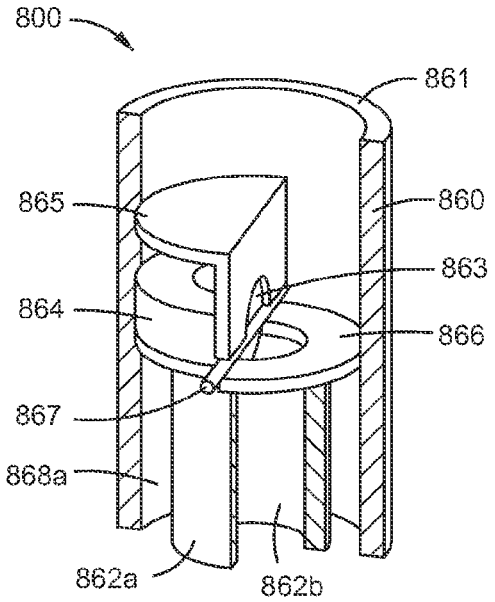

FIGS. 8A and 8B depict the temperature-sensitive magnetic valve 800 with a pipe-in-pipe design according to another embodiment. In this embodiment, the temperature-sensitive magnetic valve 800 can have a valve chamber 860, an aperture 861, a flow control structure 862*a*, a restricting device 863, a magnet 864, a protective cover 865, a ferromagnetic material 866, a pivot 867 and ports 868*a* and 868*b*. The ferromagnetic material 866, shown as a horseshoe shape, can be connected to the restricting device 863, shown as a half orb or ball design with reference to FIG. 8A. At temperatures below the curie-effect temperature, the ferromagnetic material 866 is in contact with the protective cover 865. The magnet 864 is positioned in connection with the protective cover 865 and delivers a magnetic force through the protective cover 865 to position the ferromagnetic material 866 and the restricting device 863 in the first state. The restricting device 863 prevents flow through the port 868*b* while not affecting port 868*a*.

When a preheated gas flows into the valve chamber 860 described with reference to FIG. 8B, the ferromagnetic material 866 can begin to heat up. Once the ferromagnetic material 866 reaches the curie-effect temperature, the ferromagnetic material 866 is separated from the protective cover 865 and the magnet 864. The restricting device 863 is then forced with the connected ferromagnetic material 866 into a second state by a second force, such as through gravity and pressure. The ferromagnetic material 866 and the restricting device 863 rotate on the pivot 867 until the ferromagnetic material 866 is position to block the port 868*a*. As shown here, ferromagnetic material 866 is partially resting on a portion of the flow control structure 862*a*. The restricting device 863 in the second state allows flow through the port 868*b*.

The protective cover 865 is positioned to allow the magnetic field of the magnet 864 to be delivered to the ferromagnetic material 866, while protecting the magnet 864 from the gas delivered to the valve chamber 861. The protective cover 865 can be formed of a ferromagnetic material which does not degrade in the operative environment, such as nickel or Inconel. Further, the protective cover may be a magnet itself, such as a cobalt containing magnet. The protective cover can allow stronger magnets which are not optimal for the conditions of the tube, for example magnets which are sensitive to temperatures or gases, to be used in the temperature-sensitive magnetic valve 800.

Insulation may also be used to isolate the magnet 864, in one or more embodiments described above, from the high temperatures or certain chemistries of gases delivered through the burner to the combustion chamber. For example, a very thin vacuum insulated housing may protect the magnet 864 from excess heat. Passive or active convective/conductive cooling may be utilized to keep the magnet cool, relying on other cooler process flows in the vicinity of the magnet 864. Of note, most magnets of useful size only have a field that will attract objects within a few millimeters. Thus, the amount and type of insulation used should take account of the limited range for these magnets. The insulation used to isolate the magnet 864 can be less than 10 mm.

Most designs are depicted with one magnet for simplicity purposes only. Other designs may include one or more magnets, in one or more positioning and orientations based on the needs of the user and the design of the valve, without diverging from the scope of the invention described herein. In one embodiment, additional magnets 864 could be employed for increasing the overall field strength, such as magnets oriented to create a field in the same direction, whether in series or in parallel. In another embodiment, additional magnets can be employed to achieve a more complex motion of the actuated pieces, such as magnets aligned perpendicularly to allow for a two-step series of motion below the curie-effect temperature. In another embodiment, additional magnets can be "staged" in such a way that they actuate at slightly different times due to different heating rates. In another embodiment, additional magnets and additional ferromagnetic materials can be staged so as to increase the distance travelled.

Figure 9:
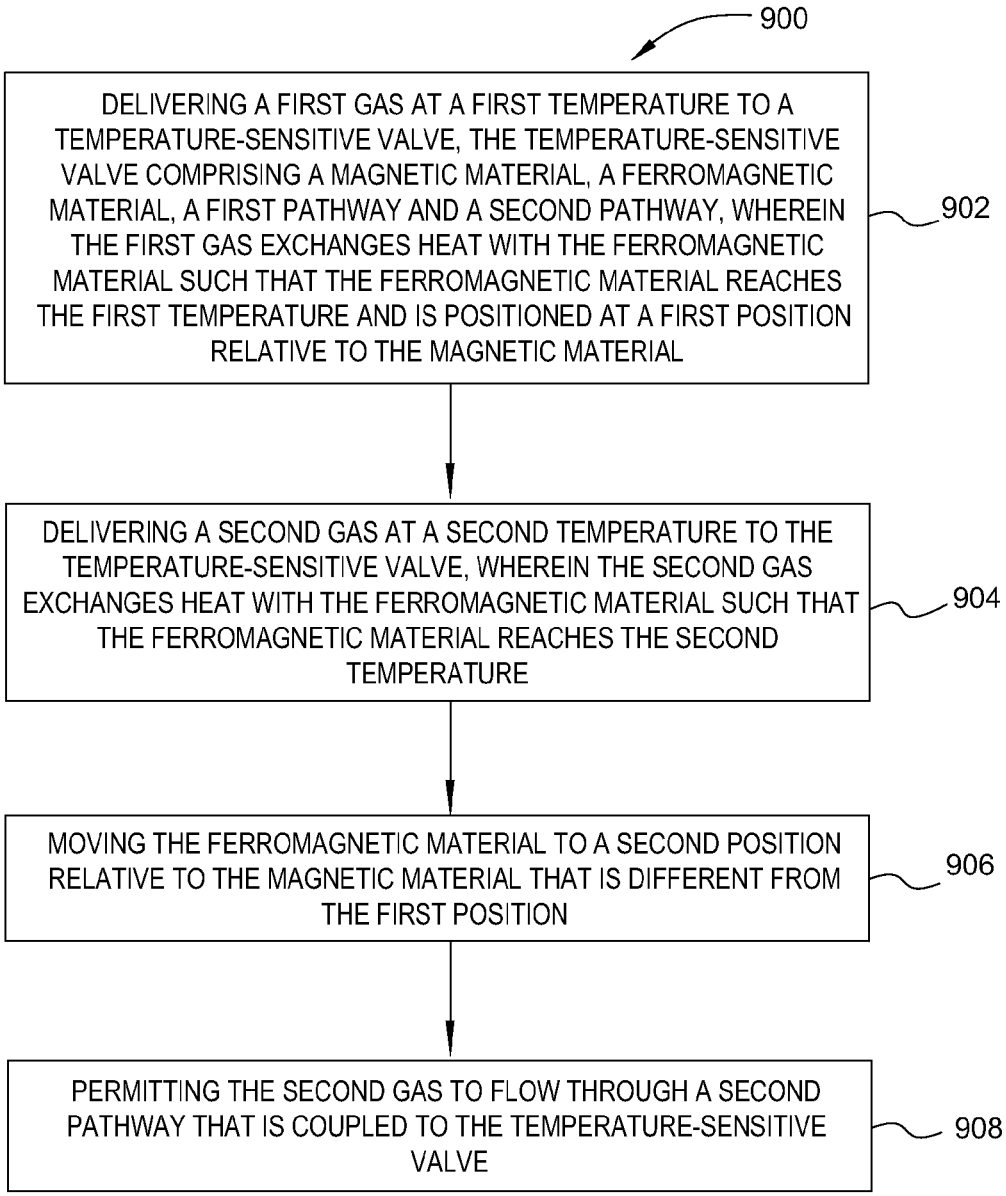
FIG. 9 is a flow diagram of a method for maintaining a substantially constant gas velocity exiting a burner, according to one embodiment.

FIG. 9 is a flow diagram of a method 900 for ensuring a substantially constant gas velocity exiting a burner regardless of the temperature of the gas exiting the burner, according to one embodiment. In embodiments described herein, a gas, such as an oxidizing gas or a fuel gas, can be heated at a point prior to flowing through an outlet of a burner. Positioned between the gas source and the outlet is a temperature-sensitive magnetic valve. When at a temperature below the curie-effect temperature for the particular ferromagnetic material, the temperature-sensitive magnetic valve is in a first state and therefore directs flow of the gas through a first pathway. The first pathway is connected with an outlet in the burner which allows the gas, at a first temperature, to exit the burner at a first velocity. As the preheated gas flows through the valve, the ferromagnetic material heats up. Once the ferromagnetic material heats to a second temperature which is at or above the curie-effect temperature, the ferromagnetic material will release from the magnet. A second force will then shift the ferromagnetic material into a second state to redirect the gas flow through a second pathway. This shift in the gas flow ensures that the preheated gas exits the burner at substantially the same velocity as the gas exiting the burner through the first pathway. Thus, the gas exiting the burner and flowing to the combustion chamber has the same velocity whether it is at the first or second temperature.

The method 900 begins at step 902 by delivering a first gas at a first temperature to a temperature-sensitive valve, the temperature-sensitive valve comprising a magnetic material, a ferromagnetic material, a first pathway and a second pathway. The gas exchanges heat with the ferromagnetic material such that the ferromagnetic material reaches the first temperature, which can be below the curie-effect temperature for the ferromagnetic material. As the gases flow into the temperature-sensitive valve, the components which are in thermal contact with the gas equilibrate based on the first temperature of the gas and the starting temperature of the components of the temperature-sensitive valve. As the gases are delivered to the temperature-sensitive magnetic valve, the components of the temperature-sensitive magnetic valve including the ferromagnetic material will change from the starting temperature to the first temperature. If the ferromagnetic material is spaced from the magnet, then, as the ferromagnetic material lowers to below the curie-effect temperature for the particular ferromagnetic material, the ferromagnetic material will become magnetically coupled to the magnet and move into the first position.

In this embodiment, the first gas exchanges heat with the ferromagnetic material such that the ferromagnetic material reaches the first temperature and is positioned at a first position relative to the magnetic material. The first position fluidly connects the gas source with the first pathway. As described above, the ferromagnetic material can be magnetically connected with the magnet when at the first temperature. Thus the magnet holds the ferromagnetic material in a first position which allows flow through the valve and through the first pathway. While the ferromagnetic material is in the first position, access to the second pathway through the temperature-sensitive magnetic valve is closed.

The terms "first pathway" and "second pathway" as used both here and above refer to the fluid connections (e.g., pipes or tubes) which are open when the temperature-sensitive magnetic valve is in the first state and second state respectively. In one or more embodiments, the first pathway and the second pathway have one or more common fluid connections. In one embodiment, the first pathway includes a first pipe and a second pipe and the second pathway includes the first pipe, the second pipe and a third pipe.

Then a second gas is delivered at a second temperature to the temperature sensitive valve, as in step 904. After equilibrating the temperature of the first gas and the temperature-sensitive magnetic valve, a second gas may be delivered to the temperature sensitive magnetic valve where the second gas is at a second temperature. The second temperature can be above the curie-effect temperature for the particular ferromagnetic material. The second gas then exchanges heat with the ferromagnetic material such that the ferromagnetic material reaches the second temperature.

The ferromagnetic material is then moved to a second position relative to the magnetic material that is different from the first position, as in step 906. As described above, once the ferromagnetic material transitions across the curie-effect temperature boundary, the interaction between the magnet and the ferromagnetic material is affected, creating a shift in position. In one embodiment, the ferromagnetic material temperature increases and thus, meets and then exceeds the curie-effect temperature. Therefore, the ferromagnetic material decouples from the magnet and moves to the second state. A second force, such as a spring or gravity can overcome the weak magnetic attraction between the magnet and the ferromagnetic material at a temperature above the curie-effect temperature thus shifting the temperature sensitive magnetic valve from the first state to the second state. In another embodiment, the second temperature can be lower than the first temperature such that once the ferromagnetic material reaches the second temperature, the ferromagnetic material is below the curie-effect temperature. Thus, the magnetic material can then exert magnetic force to move the ferromagnetic material to the second position.

The transfer of heat to the ferromagnetic material does not need to be a direct transfer. In one or more embodiments, an insulated heat pipe could sample and "transmit" heat from the area where process flow temperature is seen, to the ferromagnetic material positioned proximate, but thermally isolated from, the gas, such that the ferromagnetic material is not directly subject to the heat or chemistry of the gas. The ferromagnetic material loses magnetic attraction based on the temperature change. A mechanical connection can then transmit the action of the ferromagnetic material back to the restricting device and the flow control structure to redirect the process flow.

The second gas is then permitted to flow through a second pathway that is coupled to the temperature sensitive valve, as in step 908. After the temperature sensitive valve shifts from the first position to the second position, the second pathway is opened. The second pathway can incorporate none of, portions of or the entirety of the first pathway. The second gas is delivered through the second pathway and flows through a second outlet in the burner to the combustion chamber, such that the velocity of the gas exiting the first outlet is substantially the same as the velocity of the gas exiting the second outlet.

Regardless of which path the temperature-sensitive magnetic valve directs the gas, the gas will exit the burner at substantially the same jet velocity regardless of the temperature of the gas.

In case the temperature-sensitive magnetic valve malfunctions and the ferromagnetic feature cannot be moved toward or away from the magnet (as the case may be), movement towards or away from can be forced by judicious placement of a strong magnet so as to move the ferromagnetic feature in the desired direction. This strong magnet may be applied to an outside surface of the valve (or apparatus incorporating the valve) so that an operator may manually provide a back-up solution in case the inventive valve fails.

CONCLUSION

Embodiments described herein relate to control of gas velocity exiting a burner. Recovery of lost thermal energy is becoming more important as fuel costs rise. One important source of lost thermal energy in standard furnaces is through flue gas. This lost thermal energy can be recovered through heating of the combustion gases prior to combustion. Heating the gases however can change the velocity of the gases as delivered through the outlet of the burner to the combustion chamber. By redirecting the flow based on a threshold temperature, combustion gases can exit the burner at a constant velocity regardless of the temperature of the gases.

While the foregoing is directed to embodiments of the present invention, other and further embodiments of the invention may be devised without departing from the basic scope thereof, and the scope thereof is determined by the claims that follow.

What is claimed is:

1. A burner device, comprising:

a temperature-sensitive magnetic valve in fluid connection with a gas source, the valve comprising:

a magnet;

a ferromagnetic material in magnetic connection with the magnet, the ferromagnetic material having a curie temperature between 240 degrees Celsius and 600 degrees Celsius; and a flow control structure forming a first pathway and a second pathway;

one or more first outlets in connection with the first pathway, the first outlets having a cumulative first cross-sectional area; and one or more second outlets in connection with the second pathway, the second outlets having a cumulative second cross-sectional area which is cumulatively greater than the first cross-sectional area.

2. The burner device of claim 1, further comprising:

the flow control device with a plurality of first apertures; and the ferromagnetic material in fluid connection with the flow control device with plurality of second apertures formed therein.

3. The burner device of claim 1, wherein the ferromagnetic material comprises a nickel-containing material.

4. The burner device of claim 1, wherein the first pathway and the second pathway comprise one or more common pipes.

5. The burner device of claim 1, further comprising:

a chamber comprising a plurality of inlets; and the ferromagnetic material further comprising an opening, the opening allowing substantial flow from the plurality of inlets into the chamber.

6. The burner device of claim 1, wherein the first pathway and the second pathway comprise a pipe-in-pipe design.

7. A burner system, comprising:

a temperature-sensitive magnetic valve having a magnet and a ferromagnetic material, the ferromagnetic material having a curie temperature between 240 degrees Celsius and 600 degrees Celsius;

a gas source coupled to the temperature-sensitive valve;

a first burner outlet coupled to the temperature-sensitive magnetic valve and sized to permit gas to exit the first burner outlet at a first velocity; and a second burner outlet coupled to the temperature-sensitive magnetic valve and sized to permit gas to exit the second burner outlet at the first velocity, wherein the first burner outlet and the second burner outlet have different cross-sectional areas, and wherein the ferromagnetic material blocks the first burner outlet when magnetically coupled to the magnet and unblocks the first burner outlet when uncoupled from the magnet.

8. The burner system of claim 7, wherein the temperature-sensitive magnetic valve further comprises a flow control structure configured to form one or more barriers to flow in conjunction with the ferromagnetic material.

9. The burner system of claim 8, wherein the temperature-sensitive magnetic valve further comprises a restricting device configured to:

change position with the ferromagnetic material; and redirect the gas based on the position of the ferromagnetic material in conjunction with the flow control structure.

10. The burner system of claim 7, further comprising:

a chamber comprising the flow control structure positioned between a plurality of magnets, the flow control structure connected with the ferromagnetic material.

11. The burner system of claim 7, further comprising a protective cover configured to:

isolate the ferromagnetic material or the magnet from the gas; and transmit heat to at least the ferromagnetic material.

* * * * *